US007878828B1

(12) United States Patent
Knoll, Jr.

(10) Patent No.: US 7,878,828 B1
(45) Date of Patent: Feb. 1, 2011

(54) SAFETY SOCKET WITH PLUG CONFIGURATION SENSITIVE SWITCH

(76) Inventor: Carl Frank Knoll, Jr., 130 N. Lexington Dr., Felton, DE (US) 19943

( * ) Notice: Subject to any disclaimer, the term of this patent is extended or adjusted under 35 U.S.C. 154(b) by 0 days.

(21) Appl. No.: 12/800,161

(22) Filed: May 10, 2010

(51) Int. Cl.
*H01R 29/00* (2006.01)

(52) U.S. Cl. ..... 439/188

(58) Field of Classification Search ..... 439/188, 439/135, 137, 139, 172; 200/51.09, 51.1
See application file for complete search history.

(56) References Cited

U.S. PATENT DOCUMENTS 5,295,846 A * 3/1994 Sumida et al. ..... 439/188
5,352,128 A * 10/1994 Bricaud ..... 439/188
5,857,861 A * 1/1999 Silliman ..... 439/171
6,224,401 B1 * 5/2001 Yu ..... 439/139
7,070,432 B1 * 7/2006 Lin ..... 439/188

* cited by examiner

*Primary Examiner*—Chandrika Prasad
(74) *Attorney, Agent, or Firm*—John C. Andrade

(57) ABSTRACT

An electrical socket with a safety feature that prevents accidental shock due to insertion of an object or objects other than a typical electrical plug configuration. The socket 'hot' side conductor is not energized if an object is inserted into any single plug tang location, or if multiple objects are inserted independently, in any combination, of the socket plug tang locations.

14 Claims, 6 Drawing Sheets

*Fig. 4*
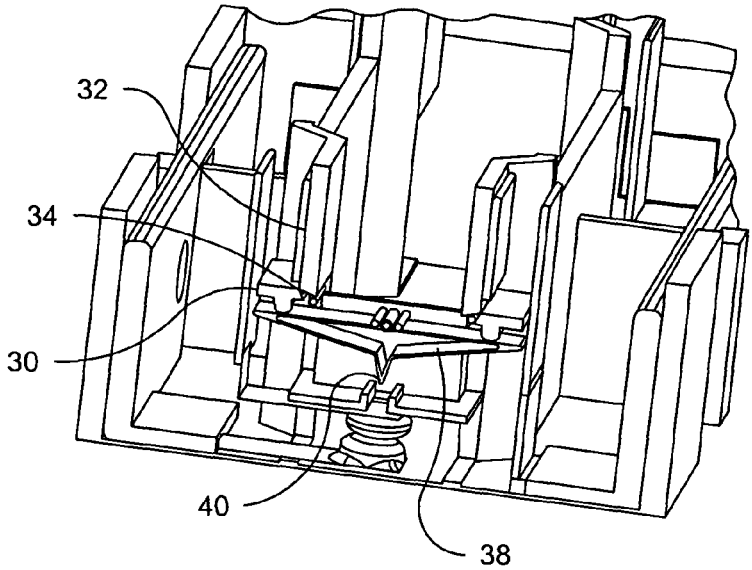
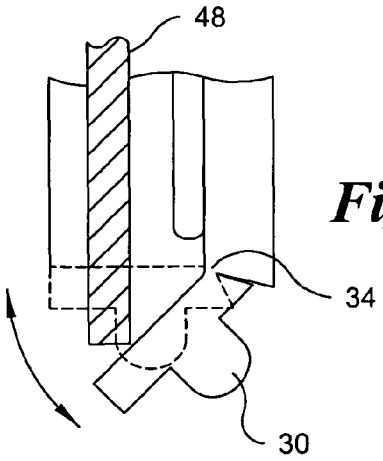
*Fig. 4a*
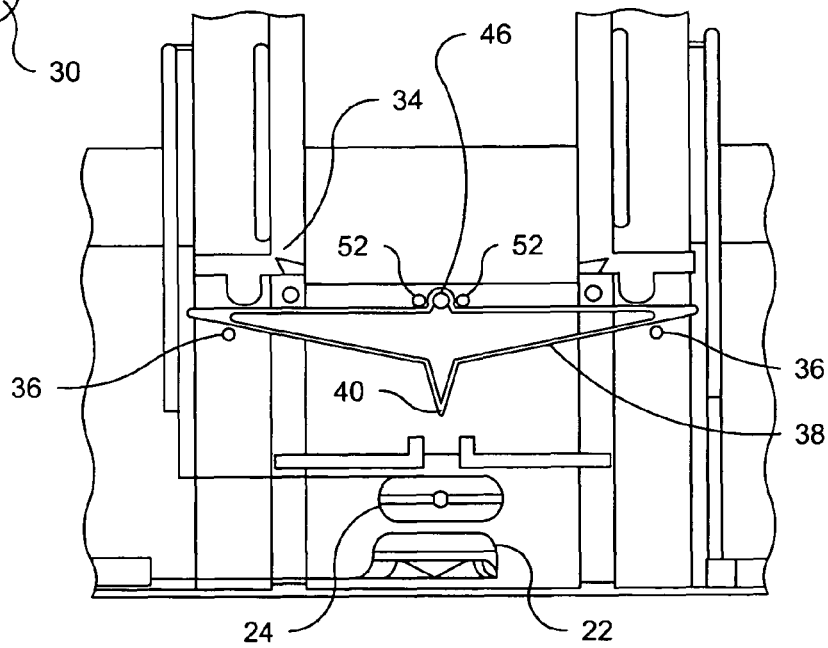
*Fig. 5*

SAFETY SOCKET WITH PLUG CONFIGURATION SENSITIVE SWITCH

BACKGROUND OF THE INVENTION

1. Field of the Invention

This invention relates to electrical outlets having safety characteristics that prevent electrical shock when other than a typical plug is inserted.

2. Description of Prior Art

The typical wall socket used in homes and businesses provide power to items plugged in via the direct contact of the item plug tangs and the socket internal conductive receivers. These internal contacts are typically directly connected to the electrical source with no internal socket switches. In the typical installation two of the three socket plug tang receiver locations are connected to ground and one is connected to the 'hot' side of the electrical source. There is a one in three chance that an unknowing person sticking a conductive object into a socket opening will receive an electrical shock.

Numerous prior safety enhancement methods have been devised to reduce the potential of an electrical shock to a person should they insert an electrically conductive foreign object into a socket. The most typical example for the need of the enhancement is that of a child sticking a metallic object into the socket. U.S. Pat. No. 6,224,401 discloses a device which provides a reduction to the risk of shock by mechanically blocking the plug insertion locations on the socket. One of the most common protection methods is by completing the circuit within the socket by a cross-strapping configuration whereas the plug tang insertion on one side (e.g., ground side) closes the circuit within the socket to the socket conductive receiver on the other side (e.g., hot side). The safety feature prevents a shock from the side a single item is plugged into because it is the other side where a connection is made by that item being inserted. While this feature is effective if no other action is taken, should that object be left in the socket and a second conductive object be inserted into the other side of the socket, there would be an exposed 'hot' conductor that could shock the person inserting the object. U.S. Pat. No. 7,070,432 is a example of this type of safety feature.

While these configurations are an improvement to a typical socket configuration, one that is always powered, they do not protect against multiple items being inserted. The typical improved configurations are also made up of many small components making the manufacturing cost and complexity a barrier to implementation.

SUMMARY OF THE INVENTION

The present invention includes a safety electrical socket having a hot source of electricity, and hot and ground conductive receivers for receiving an electrical plug having a first and second tang comprising the means for completing the electrical connection when both first and second tangs are inserted simultaneously into the socket and a means for preventing the electrical connection between said hot source and said hot conductive receiver when first and second tangs are both inserted but not simultaneously into the socket. The means for preventing the electrical connection when both first and second tangs are not inserted simultaneously preferably includes an actuator that deforms to different configurations based on the number and sequence of inserted objects into the socket plug tang receivers. The actuator includes a switch interface and is anchored within said safety electrical socket such that when a first object is inserted into the hot or the ground connection for receiving an electrical plug, but not both, the actuator deforms to a position that does not complete the electrical circuit. An 'on' electrical contacts switching means within the socket, upon insertion of the plug tangs, causes motion of the actuator switch interface which causes said electrical contacts switching means to change from completely open to completely closed. An 'off' electrical contacts switching means within the socket, upon removal of the plug tangs, causes motion of the actuator switch interface, which causes said electrical contact switching means to change from completely closed to completely open. A further preferred embodiment includes an insertion limiting means preventing the first object or any object longer than a typical plug tang from insertion to beyond a pre-determined maximum depth that could damage the actuator. The preferred embodiment would further include an isolation means located between the actuator and the hot source contact having an opening through which the actuator deformation can cause completion of the circuit.

In a preferred embodiment, the actuator is made of an electrically non-conductive material, has an electrically insulting coating (completely or at contact points) or is contacted only by electrically non-conductive actuator interfaces. The actuator in the present embodiment is not in the electrically conductive circuit path. An electrically conductive actuator provided with suitable contact points and insulation could be configured as a means of completing the circuit.

The present invention further includes a safety electrical socket having a body of the socket and a hot and ground connection for receiving an electrical plug having tangs including a hot plug tang conductive receiver, a ground plug tang conductive receiver, a hot source contact, a plug side contact connected to the hot plug tang conductive receiver, a hot wire source connection means connected to hot source contact. The present invention further includes a deformable actuator having a switch interface and an anchoring means for anchoring the actuator, connected to the anchoring means located between the conductive receivers having a hot and ground side surface suitable for contact by the hot and ground plug tangs. Upon insertion an electrical plug deforms the actuator such that the actuator switch interface moves the plug side contact to contact the hot source contact. When an object is inserted into one of the hot and ground plug tang conductive receivers, exerting any pressure on only one side of the actuator top surfaces causes the actuator switch interface to deform such that the actuator switch interface is no longer aligned with the plug side contact. The present invention further includes isolation means preferably comprising at least one isolation plate situated between the actuator switch interface and the plug side contact. The present invention further includes an opening in the isolation plate through which the actuator switch interface can move the plug side contact to contact the hot source contact. An alternative embodiment of the present invention could include inserting a deformable barrier in the form of a flap or similar alternative means, wherein the actuator contacts the deformable barrier, which contacts the plug side contact. The present invention further preferably includes an insertion limiting means with preferably an insertion limiter for preventing damage to the actuator when an object or tang that is too long is inserted and a means for pivoting the insertion limiter no more than a pre-determined maximum distance. One preferred embodiment of the actuator and contacts would be to use an electrically conductive actuator, an actuator that was electrically conductive between the top surface of the actuator where the hot plug tang contacts the actuator and the actuator switch interface or to add an electrically conductive path on the actuator between the top surface of the actuator where the hot plug tang contacts the actuator and the actuator switch interface. There would be no separate plug side contact. In this preferred embodiment a typical and properly configured plug would contact the actuator top surface with the hot tang making direct contact with the electrically conductive part of the actuator. Full insertion of the plug will cause the actuator to deform as described previously with the actuator tip/actuator switch interface allowed to deform to a position that will contact the hot source contact. The electrical path from the socket source to the plug hot tang would be completed through the hot source contact and the actuator to the plug hot tang. The neutral side plug tang would not be contacting any conductive material or components that would be energized from the hot side source. This configuration effectively eliminates the plug side contact and incorporates that function into the actuator body, actuator hot side top surface and the actuator tip/switch interface.

The present invention provides a safety wall socket configuration that provides a level of safety from accidental shock that prior safety sockets do not provide. By requiring the socket to be actuated with only a plug like configuration the probability of someone shocking themselves is substantially reduced. The internal components that provide this protection are of typical electrical switch and socket sizes and fit within existing socket body dimensions with minor reconfigurations to existing designs.

The socket configuration in this invention is relatively less complex and can distinguish between individual items being inserted into the socket plug tang locations and when a typical plug is inserted. This significantly lowers the probability of inadvertent shock by an unknowing person inserting an item (s) into the plug tang locations. The socket 'hot' plug tang mating conductor circuit is only connected to the power source when two items are inserted simultaneously and to the depth of the typical plug tang. Should one object or two objects at different times be inserted in any order and whether left in or removed, the socket 'hot' side connection will not be energized. The new configuration reduces the potential for electrical shock to the scenario where two items must be inserted at the same time such that their innermost tips simultaneously depress two independent switch actuation points. Additionally the object in the hot side location must be electrically conductive for a person to be shocked. The configuration described is for a single hot side socket where the electrical source wiring is connected to the socket with the 'hot' side connected to the switched side of the socket and the other side of the socket is at ground potential. Using the same basic switch actuation configuration a socket can also be configured to actuate two internal socket contacts via multiple spring actuators or stacked contacts.

An important function in the way this socket switch works is to prevent the two contacts only lightly touching each other. Without this, a partially inserted plug could make the contacts only barely pressing against each other. That causes high resistance and heating. This is why wall switches have that snap action when they go on and off, the contacts are either not touching at all or they are pressing hard against each other.

BRIEF DESCRIPTION OF DRAWINGS

FIG. 4 is a perspective of a section view through the end of the socket at one end of the socket plug receiving location showing the insertion limiter.

FIG. 4*a* is a cut out of the insertion limiter and the pivoting means.

FIG. 5 is a blow up end view through a section of the socket showing the hot source and plug side contacts and the actuator.

DETAILED DESCRIPTION OF A PREFERRED EMBODIMENT

The present invention is described below as it applies to the preferred embodiments. It is intended that the invention covers all modifications and alternatives included within the spirit and scope of the invention and the description and drawings to a particular embodiment of the invention is intended to be illustrative not to be construed as limiting the scope of the invention.

Figure 1:
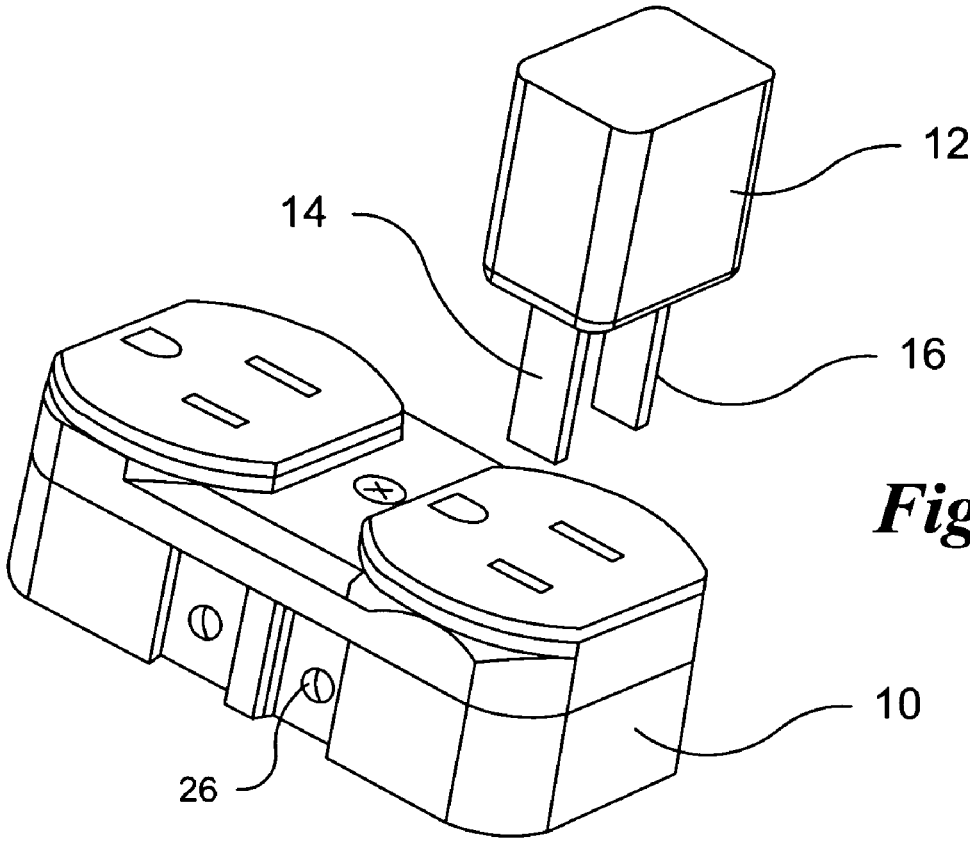
FIG. 1 is a top/side elevation view of a typical wall socket configuration that accepts two plugs.
Figure 2:
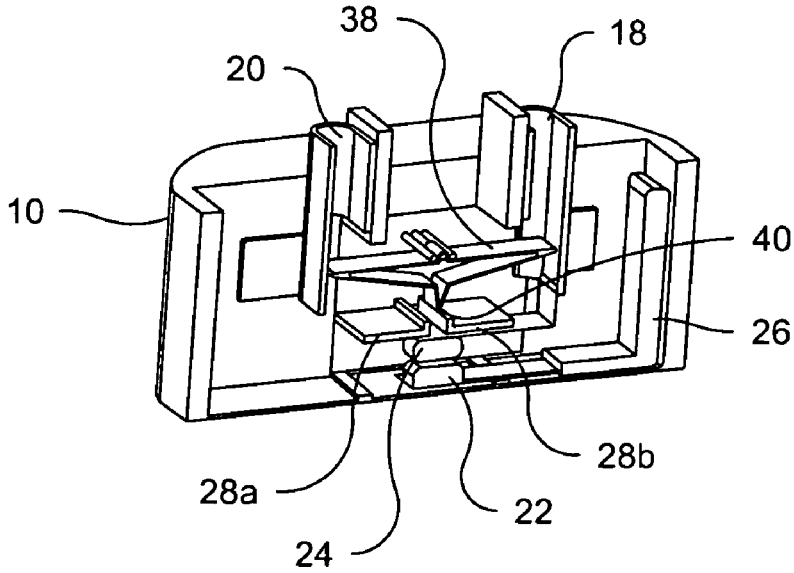
FIG. 2 is perspective of a section view through the end of the socket at one of the socket plug receiving locations showing the receiving components for that plug location.

FIG. 1 shows a typical wall socket configuration that accepts two plugs. The plug 12 is shown with the hot plug tang 14 and the ground plug tang 16 in the position that normally would be plugged into the socket 10. The hot source wire connection 26 connects to the power source. FIG. 2 shows the inside of the socket of the present invention. The initial receiving components of the socket are the hot plug tang conductive receiver 18 and the ground plug tang conductive receiver 20. Upon insertion of a plug or other object, after contacting the insertion limiter 30, shown in the preferred embodiment in FIGS. 4-5, the next thing to be contacted as the plug is inserted is the actuator 38. Shown below the actuator are the first isolation plate 28*a* and second isolation plate 28*b*. As the actuator 38 is depressed by the plug tangs 14 and 16, there is an opening between the first isolation plate 28*a* and second isolation plate 28*b* for the actuator tip 40 to pass through. The actuator 38 then contacts the plug side contact 24 and applies pressure on the plug side contact 24 forcing it in contact with the hot source contact 22. The hot side source wire connection means 26 is shown in FIG. 2. Closing these contacts provides the electrical path from the source connection 26 to the hot plug tang conductive receiver 18.

The safety electrical socket 10 provides an electrical switching of the contacts 22 and 24 from opened to closed with the simultaneous insertion of tangs 14 and 16 or closed to open with the removal of the tangs 14 and 16. The electrical switching condition is made to occur such that the contacts 22 and 24 are opened or closed completely and quickly similar to the electrical contact operation of a typical wall switch.

Figure 3A:
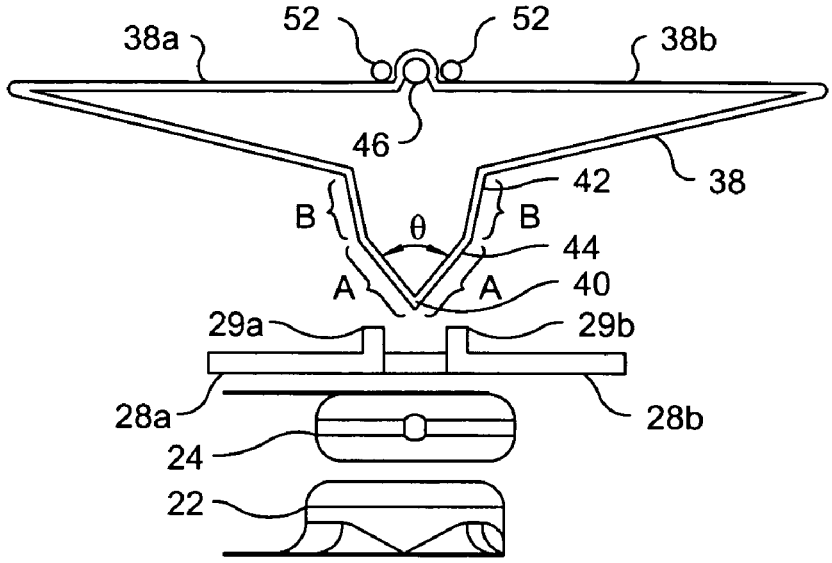
FIG. 3*a*, b and c are blow up views of the actuator showing respectively before insertion, during insertion and after full plug insertion.
Figure 3B:
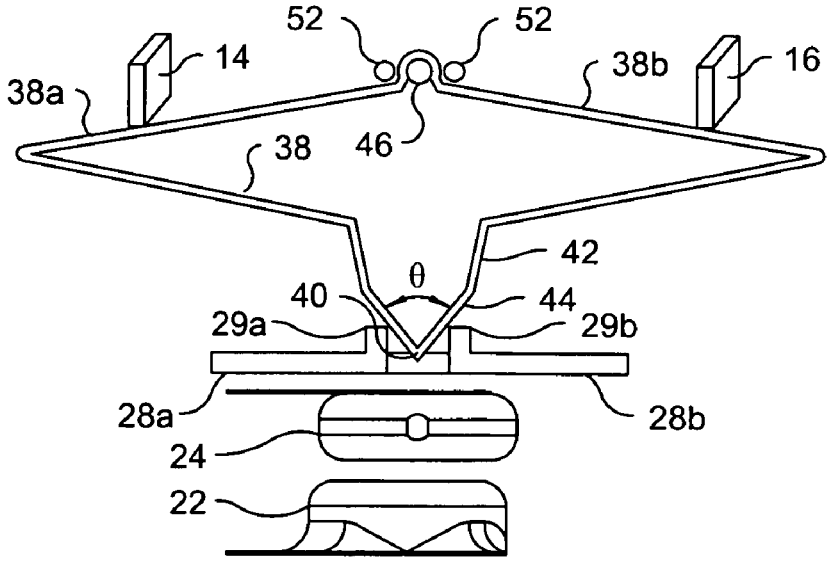
FIG. 3*d* is a blow up view after full plug insertion with an electrically conductive actuator.
Figure 3C:
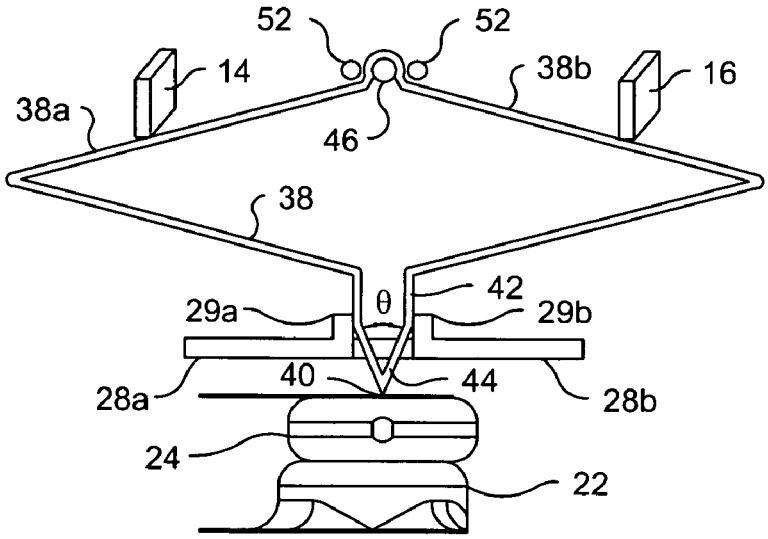

FIGS. 3*a-c* show an actuator 38 configuration with the actuator tip 40, actuator Sections 42 and 44 and isolation plate contact surfaces 29*a* and 29*b* that provide complete and quick electrical switching. As represented by BB and AA in FIG.

Figure 3D:
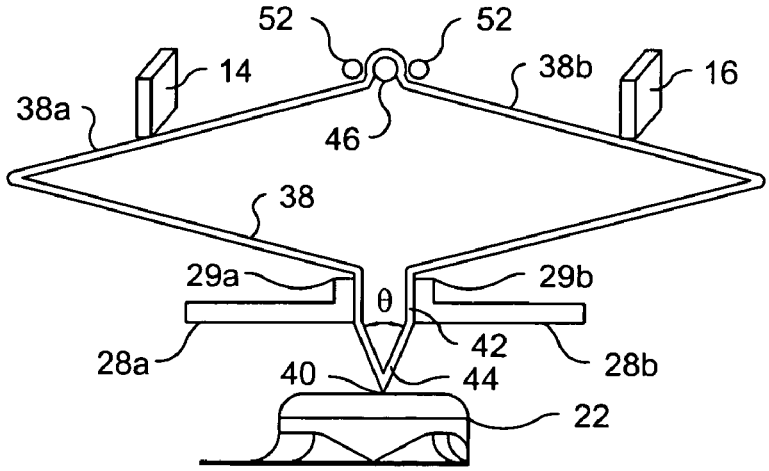

3*a*, Sections 42 and 44 are symmetrical. FIG. 3*a* shows the actuator with a first sections 42 which is angled from the body of the actuator 38 and a second sections 44 which is at a different angle than the first section 42 culminating in the switch interface represented by the actuator tip 40 as shown in FIGS. 3*a-c*. In FIG. 3*b* the simultaneously inserted tangs 14 and 16 will initially push the actuator 38 causing the actuator Sections 44 against the isolation plate contact surfaces 29*a* and 29*b*. This is the condition with a partially inserted plug and no socket internal electrical connection being made. As the plug tangs 14 and 16 are continuing to be inserted the actuator 38 upper surfaces 38*a* and 38*b* are continuing to become deformed and accumulate strain energy. The angle Theta and actuator 38 material properties are configured such that a point will be reached where the increasing stored strain energy from the plug tangs 14 and 16 moving the actuator upper surfaces 38*a* and 38*b* and deforming overall actuator 38 will not be supported by the actuator Sections 44 and isolation plate contact surfaces 29*a* and 29*b*. When exceeding the maximum force carrying capability of the actuator Sections 44 and the isolation plate contact surfaces 29*a* and 29*b*, FIG. 3*c* shows the Theta angle will be reduced and cause the actuator tip 40 to slide between the isolation plate contact surfaces 29*a* and 29*b* causing the actuator tip 40 to press against the plug side contact 24 forcing it to contact hot source contact 22. The stored strain energy in the deformed actuator 38 is such that once the Theta angle is reduced so that the actuator second Sections 44 can fit between the isolation plate contact surfaces the actuator tip 40 moves completely into the opening and is only stopped after pushing plug side contact 24 against hot source contact 22. This closed switch contact configuration will remain until the plug tangs 14 and 16 are withdrawn enough to reduce the strain energy in the actuator 38 from holding down the actuator tip 40 and the actuator Sections 44 between the isolation plate contact surfaces 29*a* and 29*b*. The actuator in the electrical path between the hot source wire connection 26 and the plug tang 14 is described in FIG. 3*d*. The hot plug tang 14 would directly contact an electrically conductive part of the actuator hot side top surface 38*a*. This electrically conductive part of the actuator hot side top surface 38*a* would have an electrical path to the actuator tip 40. The ground plug tang 16 would contact the actuator ground side surface 38*b* but be isolated from any conductive material on the actuator 38 that is connected in the path of a completed circuit between the hot source connection 26 and the plug hot tang 14. The plug side contact 24 shown in FIG. 3*c* would not be required because with a normal plug 12 insertion deformation of the actuator 38, the electrically conductive actuator tip 40 being in direct contact the hot source contact 22 and the actuator 38 with an electrically conductive path incorporated between the actuator top side contact surface 38*a* and the actuator tip 40 would complete the circuit between the hot source connection 26 and the hot plug tang 14.

FIG. 4 shows the insertion limiter 30 attached to the socket body 32 at hinge point 34. FIG. 4*a* is a blow-up which shows an object 48 being inserted and the insertion limiter 30 preventing the object from pushing down on the actuator 38 shown in FIG. 4. FIG. 5 shows an alternative mechanical limiting means 36, behind the actuator 38 in this view, as a stop for the insertion limiter 30. The mechanical limiting means 36 does not extend into the path of the actuator 38 so as not to impede the movement of the actuator 38, only the path of the insertion limiter 30. The mechanical limiting means 36 prevents the insertion limiter 30 from moving far enough for an inserted object to push further than the insertion limiters 30 when against the limiting means 36. This prevents longer than plug tang length inserted objects from being inserted too far and damaging the actuator 38.

Figure 6B:
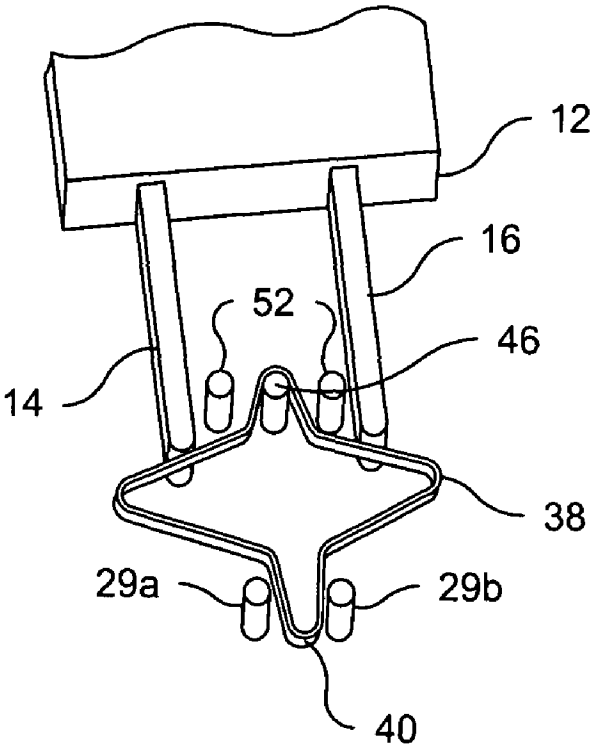
FIGS. 6*a* and *b* are a representation of plug tangs and a before and after contact with a deformable actuator.
Figure 6A:
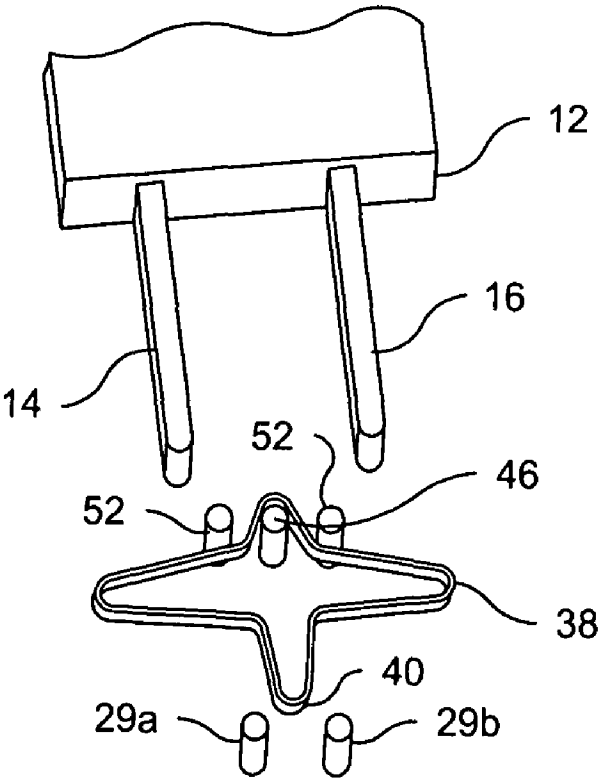
Figure 7C:
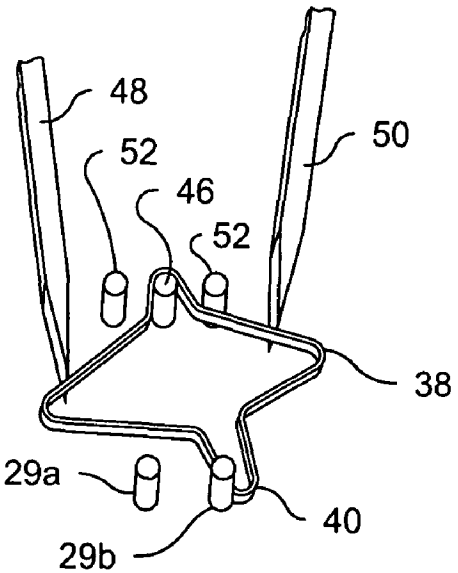
FIGS. 7*a, b* and *c* are a series of representations of the actuator deformation with an insertion sequence of multiple objects with FIG. 7*a* showing the first inserted object before contact with the actuator, FIG. 7*b* showing the actuator deformation after first object contact with the actuator, and FIG. 7*c* showing the actuator deformation after a second object contacting the actuator while the first object remained in contact with the actuator.
Figure 7B:
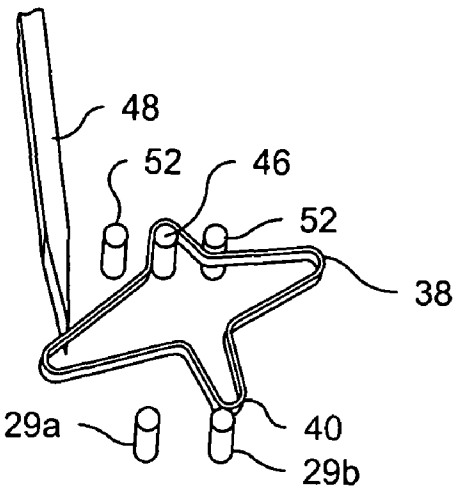
Figure 7A:
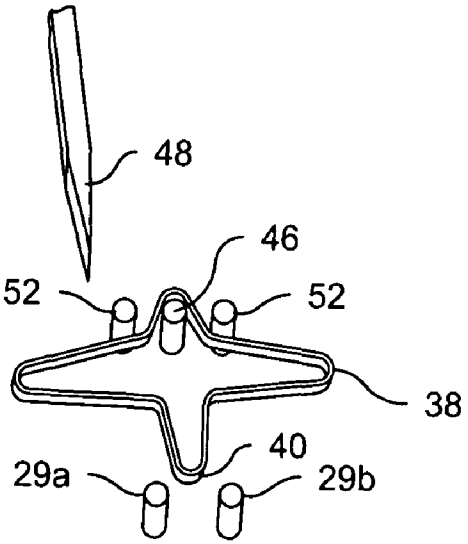

FIGS. 6*a* and 6*b* show a representation of a normal operation of an actuator. FIG. 6*a* shows the plug prior to insertion and the deformable/spring actuator 38 in an un-deformed condition. FIG. 6*b* shows that when the plug is inserted the tangs push the two sides of the deformable/spring actuator 38 down at the same time keeping the actuator tip 40 centered to allow moving through the opening. The actuator 38 deforms around an anchoring means which is the actuator 38 anchoring pin 46. Also shown are stabilizer pins 52 which prevent the actuator 38 from rotating left or right without deforming with a single object insertion. The first and second isolation plate contact surfaces 29*a* and 29*b* are represented by pins in FIGS. 6*a*, 6*b*, 7*a*, 7*b* and 7*c*. FIGS. 7*a*, *b* and *c* demonstrate how the actuator 38 prevents the electrical connection. FIG. 7*a* shows the actuator 38 in an undeformed condition. FIG. 7*b* shows that when an object 48 is inserted into one side of the socket, the actuator 38 and actuator tip 40 deforms off to the opposite side of the opening of the hot contacts resulting in no power to the plug tang contacts inside the socket. FIG. 7*c* demonstrates where a first object 48 is left in and a second object 50 is then inserted into the other side. The initial misalignment does not allow the spring actuator tip 40 to translate into the opening to make the hot contacts 24 and 22 connect. If either object is removed the spring actuator tip 40 will remain off-set from the opening.

I claim:

1. A safety electrical socket having a hot source of electricity, and hot and ground conductive receivers for receiving an electrical plug having a first and second tang comprising:

a. a means for completing the electrical connection when both first and second tangs are inserted simultaneously into said socket; and b. a means for preventing said electrical connection between said hot source and said hot conductive receiver when first and second tangs are both inserted but not simultaneously.

2. The safety electrical socket of claim 1 wherein said means for preventing said electrical connection when both first and second tangs are not inserted simultaneously includes an actuator having a switch interface and anchored within said safety electrical socket such that when a first object is inserted into said hot or ground connection for receiving an electrical plug but not both said actuator interface does not cause completion of said electrical circuit.

3. The safety electrical socket of claim 2 wherein said electrical connection for completing the connection within said safety electrical socket when both first and second said tangs are inserted simultaneously further comprises:

an 'on' electrical contacts switching means within said safety electrical socket, such that upon insertion of said tangs the said actuator switch interface motion causes said electrical contacts switching means to change from completely open to completely closed.

4. The safety electrical socket of claim 2 wherein said electrical connection for opening the connection within said safety electrical socket when both first and second said tangs are removed simultaneously comprises:

an 'off' electrical contacts switching means within said safety electrical socket such that upon removal of said tangs the said actuator switch interface motion causes said electrical contact switching means to change from completely closed to completely open.

5. The safety electrical socket of claim 2 further comprising insertion limiting means preventing said first object inserted into said socket to a depth not exceeding a predetermined maximum distance.

6. The safety electrical socket of claim 5 further comprising an isolation means and a hot source contact wherein said isolation means is located between said actuator interface and said hot source contact and prevents said actuator interface from contacting said hot source contact and completing said electrical connection when said first and second tangs are not simultaneously inserted.

7. Safety electrical socket of claim 6 further comprising an opening through said isolation means through which said actuator interface can contact said hot source contact.

8. A safety electrical socket having a body of said socket and a hot and ground connection for receiving an electrical plug having tangs comprising:

a. a hot plug tang conductive receiver;

b. a ground plug tang conductive receiver;

c. a hot source contact;

d. a plug side contact connected to said hot plug tang conductive receiver;

e. hot wire source connection means connected to said hot source contact;

f. an actuator having a hot side top surface and a ground side top surface and a switch interface;

g. an anchoring means for anchoring said actuator, connected to said anchoring means, located between said conductive receivers, such that upon insertion, said electrical plug deforms said actuator causing said actuator switch interface to contact said plug side contact, and upon insertion of an object into only one of the hot and ground plug tang conductive receivers, exerting pressure on only one of said actuator hot and ground side top surfaces, thereby causing said actuator switch interface to deform to a position such that said actuator switch interface is no longer aligned with said plug side contact.

9. The safety electrical socket of claim 8 further comprising isolation means situated between said actuator switch interface and said plug side contact.

10. The safety electrical socket of claim 9 wherein said isolation means includes at least one isolation plate.

11. The safety electrical socket of claim 10 further comprising an opening through said isolation plate through which said actuator switch interface can contact said plug side contact such that the plug side contact moves to contact said hot source contact.

12. The safety electrical socket of claim 11 further comprising an insertion limiting means preventing objects inserted into said socket to a depth not exceeding a predetermined maximum distance.

13. The safety electrical socket of claim 12 wherein said insertion limiting means includes an insertion limiter and a means for pivoting connected to said socket body.

14. A safety electrical socket having a body of said socket and a hot and ground connection for receiving an electrical plug having tangs comprising:

a. a hot plug tang conductive receiver;

b. a ground plug tang conductive receiver;

c. a hot source contact;

d. hot wire source connection means connected to said hot source contact;

e. an electrically conductive actuator having a hot side top surface and a ground side top surface and a switch interface;

f. an anchoring means for anchoring said actuator, connected to said anchoring means, located between said conductive receivers, such that upon insertion, said electrical plug deforms said actuator causing said actuator switch interface to contact said hot source contact, and upon insertion of an object into only one of the hot and ground plug tang conductive receivers, exerting pressure on only one of said actuator hot and ground side top surfaces, thereby causing said actuator switch interface to deform to a position such that said actuator switch interface is no longer aligned with said hot source contact.

* * * * *